US010165904B2

(12) United States Patent
Biagi et al.

(10) Patent No.: US 10,165,904 B2
(45) Date of Patent: Jan. 1, 2019

(54) HIDDEN SHOWER SURROUND STORAGE

(75) Inventors: Angela Rose Biagi, Chicago, IL (US); Victor Hoernig, Lowell, IN (US)

(73) Assignee: DELTA FAUCET COMPANY, Indianapolis, IN (US)

( * ) Notice: Subject to any disclaimer, the term of this patent is extended or adjusted under 35 U.S.C. 154(b) by 1212 days.

(21) Appl. No.: 11/876,799

(22) Filed: Oct. 23, 2007

(65) Prior Publication Data

US 2009/0100592 A1 Apr. 23, 2009

(51) Int. Cl.
*A47K 3/28* (2006.01)

(52) U.S. Cl.
CPC ..... *A47K 3/281* (2013.01)

(58) Field of Classification Search
CPC ..... A47K 3/28; A47K 3/281
USPC ..... 4/584, 630, 614, 605; 52/35
See application file for complete search history.

(56) References Cited

U.S. PATENT DOCUMENTS

| | | | | | |
|---|---|---|---|---|---|
| 3,496,577 | A | * | 2/1970 | Saldana | 4/551 |
| 3,827,086 | A | * | 8/1974 | Seymour et al. | 52/35 |
| D243,849 | S | * | 3/1977 | Seymour et al. | D23/275 |
| 4,048,767 | A | * | 9/1977 | Ferich | 52/35 |
| 4,457,031 | A | * | 7/1984 | Moore | 4/614 |
| D288,119 | S | * | 2/1987 | Hill et al. | D23/249 |
| 5,548,855 | A | * | 8/1996 | Jackson | 4/559 |
| D419,655 | S | * | 1/2000 | Yemini et al. | D23/283 |
| D522,636 | S | * | 6/2006 | Lanius | D23/283 |
| 2009/0038070 | A1 | * | 2/2009 | Belanger et al. | 4/607 |

* cited by examiner

*Primary Examiner* — Chee-Chong Lee
(74) *Attorney, Agent, or Firm* — Carlson, Gaskey & Olds, P.C.

(57) ABSTRACT

A planar wall member provides a portion of a tub and shower surround, and is also provided with at least one shelf. A forward wall at least partially conceals the shelf from an observer looking into the tub and shower surround.

28 Claims, 3 Drawing Sheets

HIDDEN SHOWER SURROUND STORAGE

BACKGROUND OF THE INVENTION

This application relates to a molded end wall of a tub and shower surround wherein a storage area is provided that is concealed from an observer looking into the tub and shower surround.

Modern tubs and showers are often made by mounting a tub, and then mounting walls to surround the tub. The walls are typically molded to be planar members that are secured to the underlying walls of a structure around the tub.

Tub and shower surrounds such as described above are provided with storage areas such as soap dishes, etc. Shelves may be provided.

However, all of the known storage areas that have typically been provided are in clear view of an observer. Thus there is some aesthetic detraction to the way they have been provided.

SUMMARY OF THE INVENTION

In the disclosed embodiment of this invention, a storage area is molded onto an end wall of a tub and shower surround. A forward wall blocks an observer from seeing the storage area from an orientation looking into the tub surround.

These and other features of the present invention can be best understood from the following specification and drawings, the following of which is a brief description.

DETAILED DESCRIPTION OF THE PREFERRED EMBODIMENT

Figure 1:
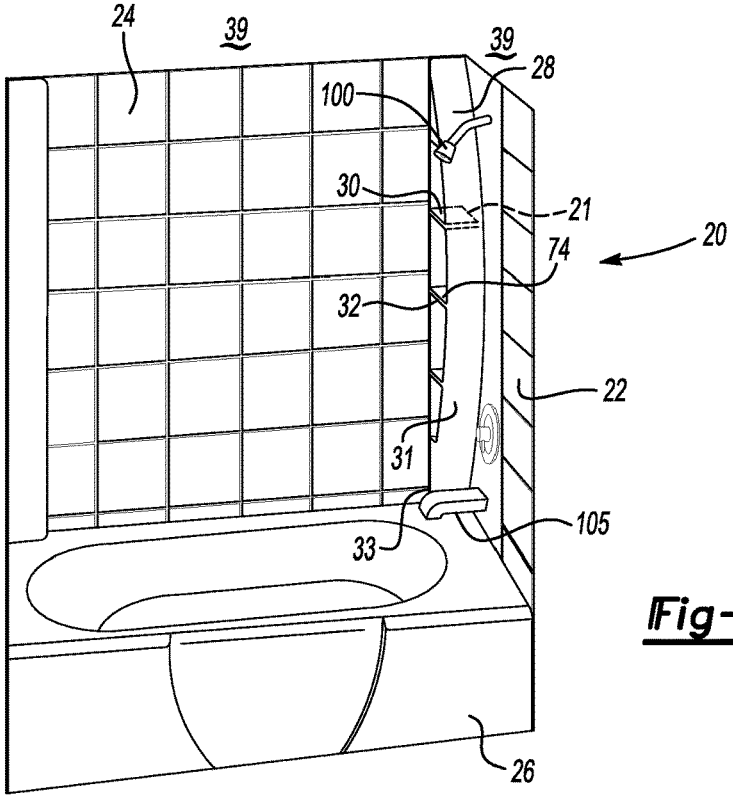
FIG. 1 is a perspective view of a first embodiment.

FIG. 1 shows a tub and shower surround 20. As known, end walls 22 may be molded of plastic into a planar shape to be secured to an underlying structure (see also FIG. 3) such as structure walls 39. The rear wall 24 is similarly formed. Two end walls and a rear wall typically are mounted about a tub 26. In some applications, part of the rear wall can be formed with the end walls, and this application may extend to such systems. As shown in FIGS. 1-4, the rear wall 24 and the two end wall 22 are attached directly to and are in parallel with the structure walls 39.

In the tub and shower surround 20, a forward wall 28 conceals a plurality of storage shelves 30. The shelves 30 and forward wall 28 are molded to extend integrally and perpendicularly away from the planar end wall 22.

Shower and tub spouts (100, 105 respectively) are shown.

Figure 2:
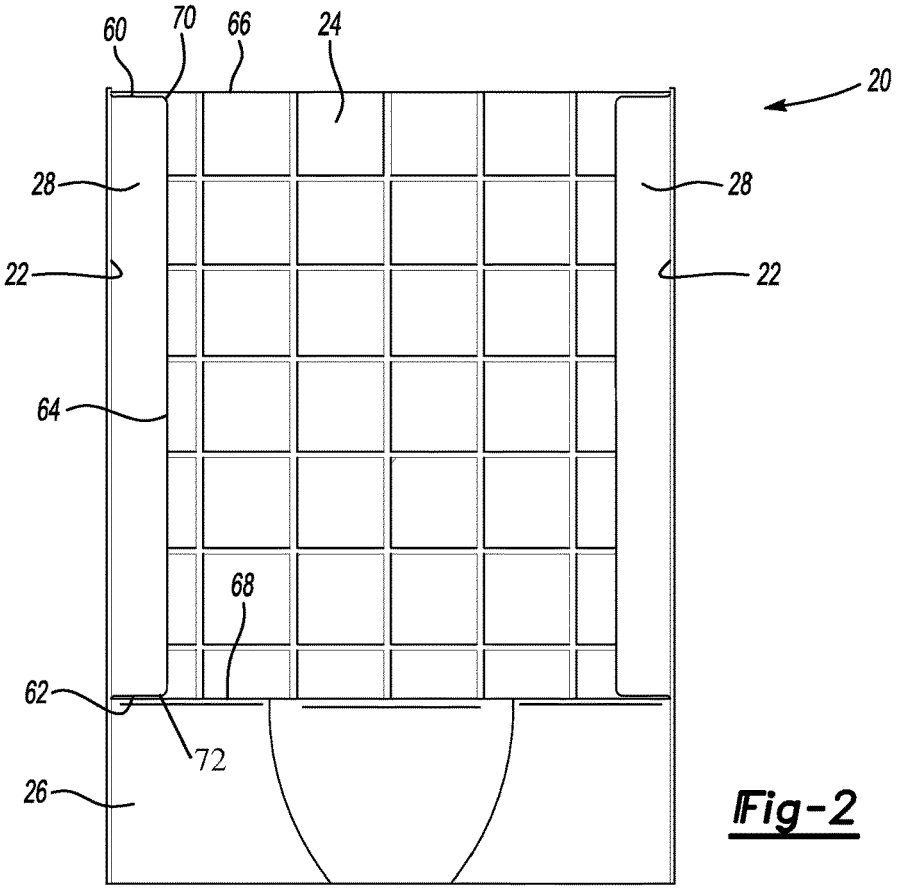
FIG. 2 is a front view of the first embodiment.

As shown in FIG. 2, an observer looking into the tub and shower surround 20 does not see the shelves 30, but rather sees the forward walls 28. Of course, if one is looking into the tub and shower surround 20 at an angle, the shelves 30 will be observable, however, the forward walls 28 do conceal a good deal of the shelves. The forward walls 28 have a top 60, a bottom 62, and an inner edge 64 facing into the shower surround 20. The top 60 is at or near a top 66 of the back or side walls 22, 24 and the bottom is at or near a top of the tub 68 (or the bottom of back or side walls 22, 24). The inner edge 64, which is most distal from the planar end wall 22, has a length that extends linearly a distance from and between an inner end 70 facing into the shower surround 20 of the top 60, to an inner end 72 facing into the shower surround 20 of the bottom 62 whereby the shelves 30 are bounded along the entire length of its side 74 by the forward wall 28. The forward wall 28 extends from a top 66 of the rear and side walls 22, 24 to a top 68 of the tub 26.

In the embodiment shown in FIGS. 1 and 2, the forward wall 28 does not extend directly vertically, but as can be seen in FIG. 1, it is curved outwardly from a top 29 of the rear wall 24 to a point 31 near a middle of the forward wall and inwardly to a bottom 31 of the rear wall 24.

Figure 3:
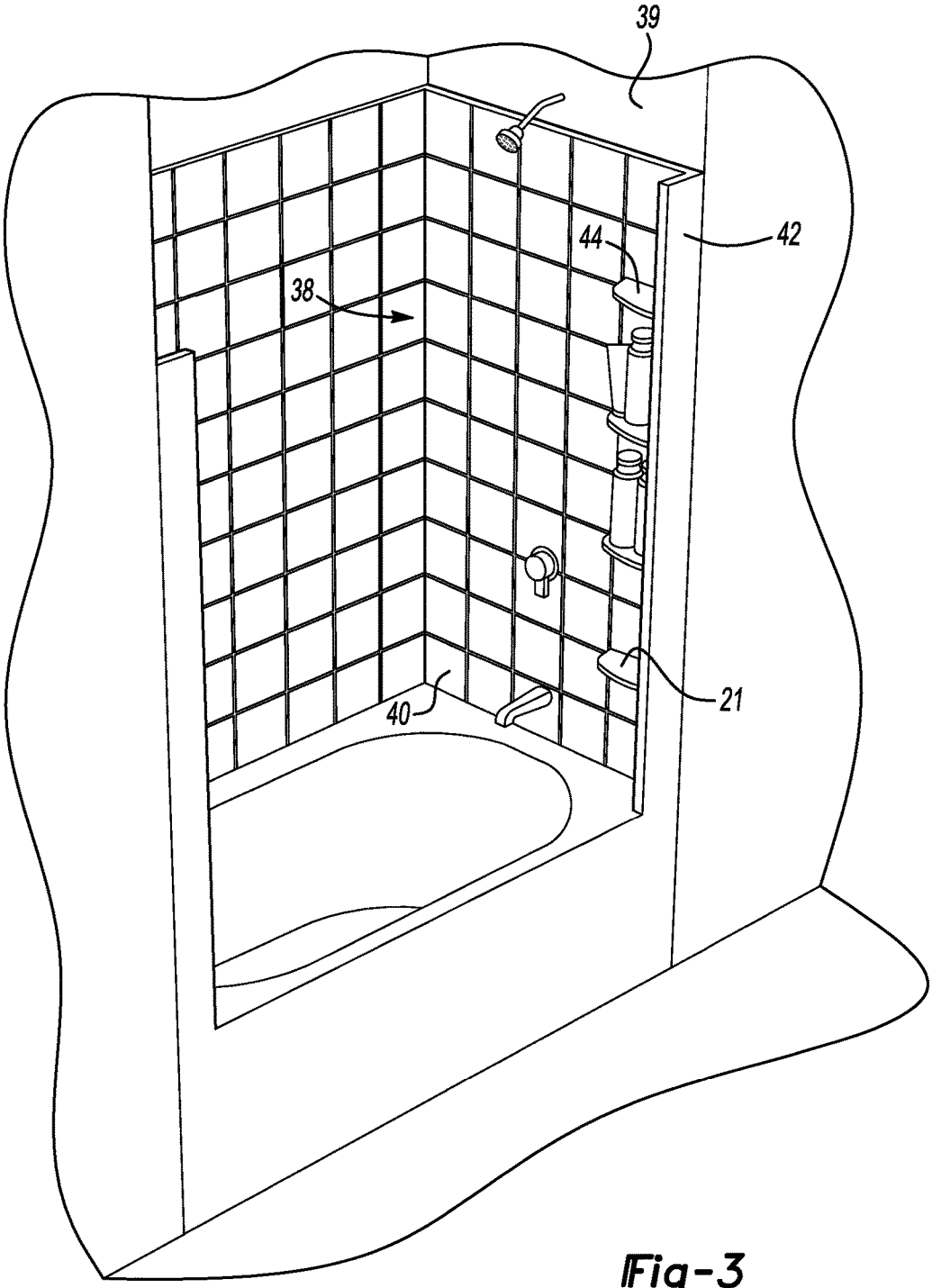
FIG. 3 shows a second embodiment.

FIG. 3 shows another embodiment 38, wherein the forward wall 42 does extend directly vertically and again conceals shelves 44. In this embodiment, the shelves 44 and end wall 42 are again formed to extend perpendicularly away from the planar end wall 40.

As can be appreciated from FIGS. 1 and 3, the forward wall can be directly vertical or curved, and the shelves and end wall may be positioned toward an inner end of the end wall, or at an outer end.

Further, other shapes for the end walls and shelves would come within the scope of this invention. Five designs are shown in co-pending design patent applications 29/296522; 29/296523; 29/296517; 29/296516; and 29/296526, all entitled "Hidden Shower Storage," filed on even date herewith, and naming the same inventors.

Figure 4:
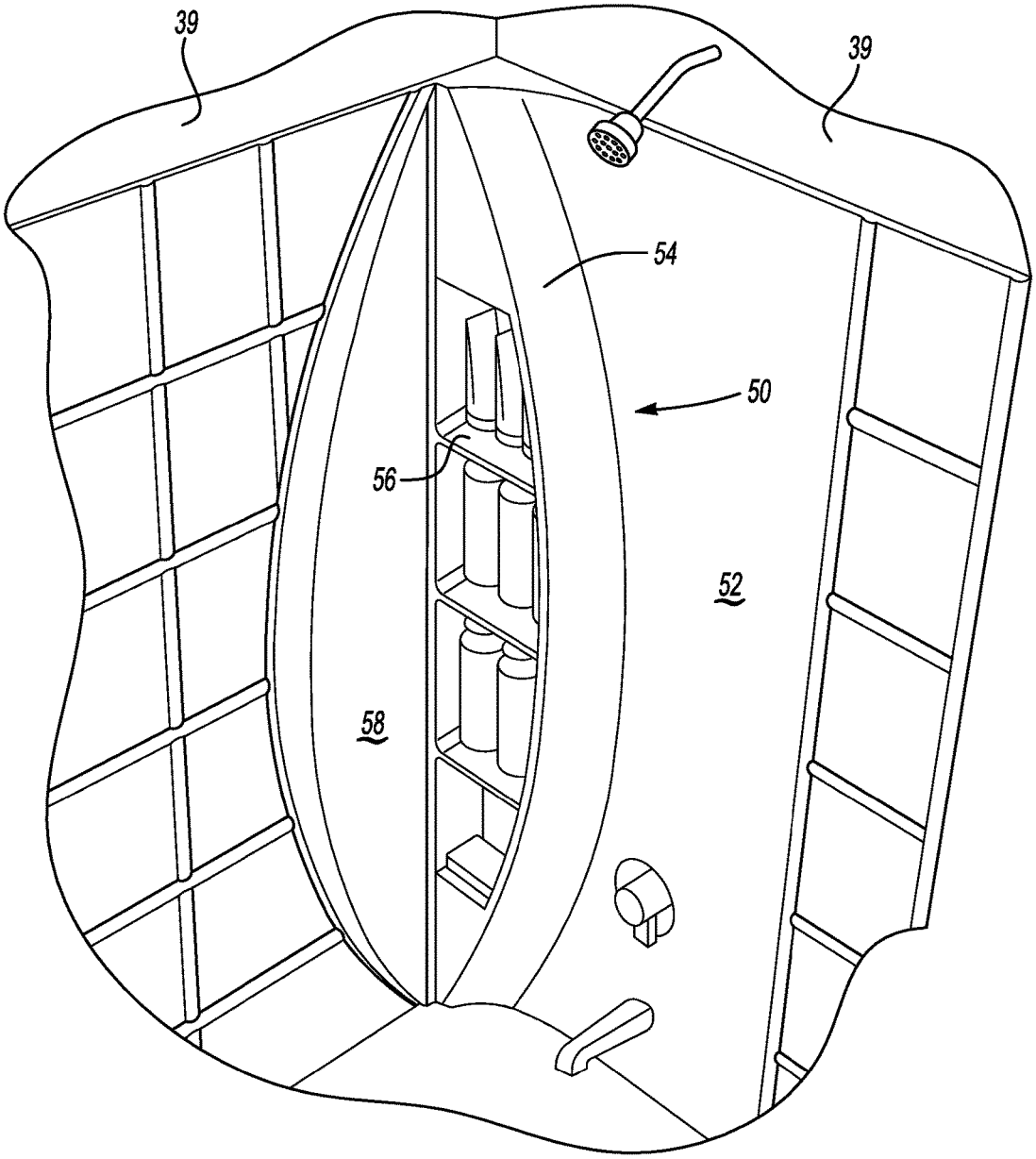
FIG. 4 shows a third embodiment.

FIG. 4 shows yet another embodiment 50, wherein the end wall 52 is molded to have a forward wall 54 concealing shelves 56, not unlike the FIG. 1 embodiment. However, a door 58 is pivotally attached to the end wall 52 such that it can be closed to further conceal the shelves 56. Again, various shapes for the door and storage areas could be utilized to provide this feature.

At least one shelf extends perpendicularly away from a planar wall member 22 from an inner end 21 thereof, for a first distance to an outer end 32 most distal from the planar wall member 22. A forward wall 28 extends away from the planar wall member for a distance that is at least as far as the end 32 and is positioned on a side of the at least one shelf that is spaced toward an outside location when the planar wall member is mounted into the structure. The forward wall at least partially blocks a sight line for the at least one shelf.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A shower surround wall comprising:

a molded planar wall member for attaching directly to a structure wall and in parallel thereto;

an opposing wall facing opposite said molded planar wall member, said opposing wall for attaching directly to another structure wall and in parallel thereto;

at least one shelf extending away from said molded planar wall member and toward said opposing wall, said shelf having a shelf end most distal from said molded planar wall member, and wherein said at least one shelf is open to a direction facing into the shower surround wall, and wherein said at least one shelf extends only partially across a width of said molded planar wall member;

a forward wall extending away from said molded planar wall member and toward said opposing wall, said forward wall having a top, said top having a first inner end, and a bottom having a second inner end, said first and second inner ends facing into said shower surround wall, and an inner edge extending linearly along a length between said first inner end and said second inner end, said inner edge extending from said molded planar wall member for a distance that is at least as far as said shelf end and positioned on a side of said at least one shelf wherein the forward wall faces toward a location outside of said shower surround wall when said molded planar wall member is mounted to the structure wall, such that said forward wall at least partially blocks a sight line to said at least one shelf; and a rear wall configured to extend between said molded planar wall member and said opposing wall, said rear wall extending perpendicular to said molded planar wall member and said opposing wall, and wherein said shelf end is parallel to said molded planar wall member and said opposing wall.

2. The shower surround wall as set forth in claim 1, wherein there is a plurality of said shelf.

3. The shower surround wall as set forth in claim 2, wherein said shelves start at said molded planar wall member that is in said shower surround wall when said molded planar wall member is mounted directly to the structure wall.

4. The tub and shower surround wall as set forth in claim 2, wherein said forward wall is at an outer edge of said molded planar wall member, when said molded planar wall member is mounted to a structure.

5. The tub and shower surround wall as set forth in claim 1, wherein a door is attached to conceal a storage area provided by said at least one shelf.

6. The tub and shower surround wall as set forth in claim 1, wherein said forward wall extends in a direction which will be directly vertical when said molded planar wall member is mounted to a structure.

7. The shower surround wall as set forth in claim 1, wherein said forward wall defines a curved surface that faces a direction that is outside of said shower surround wall.

8. The shower surround wall as set forth in claim 7, wherein said molded planar wall member comprises a shower end wall and including a molded shower rear wall that is formed together with said shower end wall and said forward wall, and wherein said curved surface has at least a first portion spaced from the rear wall by a first distance and a second portion spaced from the rear wall by a second distance greater than the first distance.

9. The shower surround wall as set forth in claim 1, wherein said forward wall only extends as far as said shelf end of said shelf.

10. The shower surround wall of claim 1, wherein said molded planar wall member comprises a first end wall and said opposing wall comprises a second end wall, and wherein the rear wall is configured to extend entirely across a rear wall structure between said first and second end walls to define a shower open area, and wherein said first end wall directly faces said second end wall and wherein said rear wall is formed with said first end wall, and wherein said at least one shelf attaches to said first end wall and to said rear wall such that when facing said rear wall said at least one shelf is not visible.

11. The shower surround wall of claim 1, wherein said inner edge extends from a top of said shower surround to a top of a tub.

12. The shower surround wall of claim 1, wherein said inner edge extends an entire length of said molded planar wall member.

13. The shower surround wall as set forth in claim 1, wherein said molded planar wall member comprises a first shower end wall and said opposing wall comprises a second shower end wall, and including a molded shower rear wall that is formed together with at least said first shower end wall and said forward wall, said molded shower rear wall configured to extend entirely across a rear wall structure defining a shower open area.

14. The shower surround wall as set forth in claim 1, wherein said molded planar wall member is defined by a height extending from a wall member top to a wall member bottom and is defined by said width which extends from a first wall edge at a shower rear wall and a second wall edge spaced outwardly from said first wall edge, and wherein said opposing wall has the same height and width as the molded planar wall member to form a shower surround that is configured to be mounted about a tub, and wherein said at least one shelf extends across less than half of said width of said molded planar wall member.

15. The shower surround wall as set forth in claim 14, wherein said at least one shelf extends from said forward wall in an axial direction toward the shower rear wall to define a shelf length, and wherein said shelf length does not extend axially beyond a shower spout location.

16. The shower surround wall as set forth in claim 1, wherein said at least one shelf comprises a plurality of shelves that are spaced apart from each other in a vertical direction by open spaces such that items supported by the plurality of shelves are accessible from within the shower surround wall.

17. A shower surround wall comprising:

a molded planar wall member for attaching directly to a structure wall and in parallel thereto;

an opposing wall facing opposite said molded planar wall member, said opposing wall for attaching directly to another structure wall and in parallel thereto;

a rear wall formed with said molded planar wall member and extending between the molded planar wall member and the opposing wall such that said molded planar wall member directly faces said opposing wall;

at least one shelf extending away from said molded planar wall member and toward said opposing wall, said shelf having a shelf end most distal from said molded planar wall member and a side extending a length from said molded planar wall member to said shelf end, and wherein said at least one shelf is open to a direction facing into the shower surround wall;

a forward wall extending away from said molded planar wall member and toward said opposing wall, wherein said at least one shelf extends from said forward wall in an axial direction toward said rear wall to define a shelf length, and wherein said shelf length extends only partially across a width of said molded planar wall member;

wherein said forward wall has a top, said top having a first inner end, and a bottom having a second inner end, said first and second inner ends facing said opposing wall, and an inner edge extending linearly along a length between said first inner end and said second inner end, said inner edge extending from said molded planar wall member for a distance that is at least as far as said shelf end and positioned on a side of said at least one shelf, such that said forward wall bounds said shelf length; and said rear wall extends perpendicular to said molded planar member and said opposing wall, and wherein said shelf end is parallel to said molded planar wall member and said opposing wall.

18. The shower surround wall as set forth in claim 17, wherein there is a plurality of said shelf.

19. The shower surround wall as set forth in claim 18, wherein said plurality of said shelf starts at said molded planar wall member that is in said shower surround wall when said molded planar wall member is mounted directly to the structure wall.

20. The shower surround wall as set forth in claim 17, wherein said forward wall defines a curved surface that faces a direction that is outside of said shower surround wall.

21. The shower surround wall as set forth in claim 17, wherein said forward wall only extends as far as said shelf end of said shelf.

22. The shower surround wall of claim 17, wherein said molded planar wall member comprises a first end wall and said opposing wall comprises a second end wall, and wherein said rear wall is configured to extend entirely across a rear wall structure defining a shower open area, and wherein said rear wall is formed together with said first end wall, and wherein said side of said shelf attaches to said molded planar wall member and to said rear wall such that when facing the rear wall the at least one shelf is not visible.

23. The shower surround wall of claim 17, wherein said inner edge extends from a top of said shower surround wall to a top of a tub.

24. The shower surround wall of claim 17, wherein said inner edge extends a length of said molded planar wall member.

25. The shower surround wall as set forth in claim 17, wherein said molded planar wall member comprises a shower end wall and wherein the rear wall comprises a molded shower rear wall that is formed together with said shower end wall and said forward wall, said molded shower rear wall configured to extend entirely across a rear wall structure defining a shower open area.

26. The shower surround wall as set forth in claim 17, wherein said molded planar wall member is defined by a height extending from a wall member top to a wall member bottom and is defined by said width which extends from a first wall edge at a shower rear wall and a second wall edge spaced outwardly from said first wall edge, and wherein said opposing wall has the same height and width as the molded planar wall member to form a shower surround that is configured to be mounted about a tub, and wherein said at least one shelf extends across less than half of said width of said molded planar wall member.

27. The shower surround wall as set forth in claim 17, wherein said at least one shelf comprises a plurality of shelves that are spaced apart from each other in a vertical direction by open spaces such that items supported by the plurality of shelves are accessible from within the shower surround wall.

28. The shower surround wall as set forth in claim 17, wherein said shelf length does not extend axially beyond a shower spout location.

* * * * *